US010368398B2

(12) United States Patent
Bizard

(10) Patent No.: US 10,368,398 B2
(45) Date of Patent: Jul. 30, 2019

(54) BIMETAL THERMAL ELEMENT AND THE MANUFACTURING METHOD THEREOF

(75) Inventor: Bernard Bizard, Grenoble (FR)

(73) Assignee: Schneider Electric Industries SAS, Rueil Maimaison (FR)

( * ) Notice: Subject to any disclaimer, the term of this patent is extended or adjusted under 35 U.S.C. 154(b) by 1127 days.

(21) Appl. No.: 14/236,680

(22) PCT Filed: Mar. 6, 2012

(86) PCT No.: PCT/EP2012/053814

§ 371 (c)(1),
(2), (4) Date: Feb. 3, 2014

(87) PCT Pub. No.: WO2013/017294

PCT Pub. Date: Feb. 7, 2013

(65) Prior Publication Data

US 2014/0166639 A1 Jun. 19, 2014

(30) Foreign Application Priority Data

Aug. 3, 2011 (CN) ..... 2011 1 0221464

(51) Int. Cl.
*H05B 3/02* (2006.01)
*H01H 69/00* (2006.01)
(Continued)

(52) U.S. Cl.
CPC ..... *H05B 3/02* (2013.01); *H01H 69/00* (2013.01); *H01H 71/164* (2013.01); *Y10T 29/49083* (2015.01)

(58) Field of Classification Search
CPC ..... H01H 71/164; H01H 69/00; H01H 71/74; H01H 71/7418; H01H 2071/749; H05B 3/02; Y10T 29/49083
(Continued)

(56) References Cited

U.S. PATENT DOCUMENTS 1,950,246 A * 3/1934 Hyland ..... H03L 1/04 219/210
1,955,324 A * 4/1934 Crichton ..... H01H 71/164 337/107
(Continued)

FOREIGN PATENT DOCUMENTS

| | | |
|---|---|---|
| CH | 232754 | 6/1944 |
| DE | 19646003 | 11/1997 |
| DE | 19646003 C1 | 11/1997 |

OTHER PUBLICATIONS

English Language Machine Translation of German Patent Application Publication No. DE19646003C1, 7 pages.
(Continued)

*Primary Examiner* — Eric S Stapleton
(74) *Attorney, Agent, or Firm* — Locke Lord LLP

(57) ABSTRACT

A bimetal thermal element adapted to assembling into a support. The bimetal thermal element includes: a bimetal strip having a first end and a second end opposite to the first end, and a notch formed at the first end; a heater made of a resistant strip including a linear portion and a wound portion, wherein the linear portion is straight and extending from a first position near the second end of the bimetal strip in a direction parallel to the bimetal strip and the wound portion is wound around the bimetal strip and the linear portion; and an insulating device to insulate the bimetal strip from the heater. With this design, there is also no current within the bimetal strip and its support, so the deflection of the bimetal strip is generated only by the temperature-rise coming from the resistant strip, therefore, it can realize a long tripping time.

21 Claims, 13 Drawing Sheets

(51) Int. Cl.
*H01H 71/16* (2006.01)
*H01H 61/013* (2006.01)

(58) Field of Classification Search
USPC ..... 219/531; 29/611; 337/94, 129
See application file for complete search history.

(56) References Cited

U.S. PATENT DOCUMENTS 2,250,439 A * 7/1941 Persons ..... H01H 37/56 337/103
2,254,687 A * 9/1941 Koei ..... H01H 37/56 337/111
2,366,178 A * 1/1945 Chace ..... B32B 15/015 420/470
2,417,912 A * 3/1947 Clark ..... H02P 1/42 318/473
2,428,539 A * 10/1947 Armstrong ..... H01H 71/164 318/708
2,446,474 A * 8/1948 Harrold ..... H02H 7/085 318/473
2,468,996 A * 5/1949 Olson ..... H01H 37/56 310/307
2,477,845 A * 8/1949 Youhouse ..... H01C 1/16 219/212
2,482,897 A * 9/1949 Chace ..... B32B 15/015 428/618
2,572,059 A * 10/1951 Schlaich ..... G01K 5/68 374/204
2,906,840 A * 9/1959 Ulanet ..... H01H 37/68 337/360
2,949,906 A * 8/1960 Voigt ..... F02D 17/04 123/179.3
3,031,735 A * 5/1962 Jepson ..... A47J 37/105 219/438
3,138,684 A * 6/1964 Baak ..... H05B 1/0213 337/101
3,252,215 A * 5/1966 De Long ..... B05D 7/14 29/458
3,254,180 A * 5/1966 Flanagan ..... H01H 37/52 337/131
3,272,943 A * 9/1966 Trouilhet ..... H01H 71/164 337/102
3,371,175 A * 2/1968 Benedik ..... H01H 37/30 337/102
3,534,314 A * 10/1970 Ellenberger ..... H01H 43/304 337/103
3,578,947 A * 5/1971 McNair ..... A45D 1/04 132/229
3,750,074 A * 7/1973 Ellenberger ..... E05B 47/0009 337/77
3,789,220 A * 1/1974 Schacht ..... H05B 37/0218 250/206
3,911,564 A * 10/1975 Marcoux ..... B60T 17/225 29/611
4,000,484 A * 12/1976 Ellenberger ..... H01H 71/7436 337/109
4,044,325 A * 8/1977 Krasser ..... H01H 71/02 337/113
4,067,480 A * 1/1978 Gasser ..... B65D 83/72 222/146.3
4,376,926 A * 3/1983 Senor ..... H01H 37/5418 337/104
4,516,098 A * 5/1985 Krasser ..... H01H 71/1027 335/191
4,528,539 A * 7/1985 Forsell ..... H01H 83/223 337/38
5,184,269 A * 2/1993 Shimada ..... H01H 81/02 337/3
5,367,279 A * 11/1994 Sakai ..... H01H 71/164 337/104
5,497,286 A * 3/1996 Shimada ..... H01H 81/02 337/102
2011/0248815 A1* 10/2011 Feil ..... H01H 71/164 337/94

OTHER PUBLICATIONS

International Preliminary Report on Patentability for International Application No. PCT/EP2012/053814, dated Feb. 4, 2014, 5 pages.
International Search Report for International Application No. PCT/EP2012/053814—Date of Completion of Search: May 23, 2012, 2 pages.

* cited by examiner

BIMETAL THERMAL ELEMENT AND THE MANUFACTURING METHOD THEREOF

This application is a U.S. National Phase filing of International Patent Application No. PCT/EP2012/053814 filed Mar. 6, 2012, which claims priority to Chinese patent application No. 201110221464.1 filed Aug. 3, 2011, the entire contents of which are incorporated herein by reference.

TECHNICAL FIELD

This application relates to a bimetal thermal element and the method to manufacture the bimetal thermal element.

TECHNICAL BACKGROUND

In the motor application field, overload relays are used to protect the motor windings from over heating.

The principle of these overload relays consists of detecting the overload currents through the deflection of one or more bimetal strips due to the temperature rise provided by the current. The motor current either directly goes through the bimetal strip and or through a heater made of an appropriate resistant strip wound around it. The subassembly made of the bimetal strip, the heater and the insulating sheath is called a bimetal thermal element.

Relays designed for long tripping times are dedicated for some applications where the loads driven by the motors are huge and so the starting durations to get their full speeds are long.

Overload relay tripping times may refer to the classes defined within the international standards, for instance the standard IEC 60947-4. For example, if the tripping time under 7.2 In (In=nominal current) is between 6 and 20 s starting from a cold state, a relay is marked class 20.

The structure of a conventional bimetal thermal element 11 can be seen from FIG. 1. As shown in FIG. 1, it is made of the following components: a bimetal strip 14; a heater 15 made of a resistant strip wound around the bimetal strip 14, with several turns according to the electrical resistance to be obtained, and welded on the bimetal strip 14, and the end portion is connected to a terminal in the relay case (not shown in FIG. 1); an insulating sheath 16 to electrically insulate the heater 15 from the bimetal strip 14. The bimetal element 11 is assembled with a support 12 by different techniques such as riveting or laser welding and an input wire 13 connected with a motor is connected with the support 12.

As can be seen from above description, the current flows via the following path: from the input wire 13 to the bimetal support 12; from the bimetal support 12 to a first end of the bimetal strip 14 welded with the support 12; from the first end to a second end of the bimetal strip 14 opposite to the first end; from the second end of the bimetal strip 14 to the resistant strip 15 through the welding point between the resistant strip 15 and the bimetal strip 14; finally crossing all the turns of the resistant strip 15 around the bimetal strip 14 and reaching the welded to relay terminal. Therefore there is current in both the bimetal strip 14 and the bimetal support 12. For this configuration, since there is current in both the bimetal strip 14 and the bimetal support 12, the deflection of bimetal strip 14 is generated by the temperature-rise coming from the heater 15 as well as from the bimetal strip 14 and the bimetal support 12, and thus, it is hard to realize a long tripping time.

For the situation where a long tripping time is needed, usually a multi-strip heater made of several very thin and flexible strips in parallel welded together at both of their ends is used. This heater can be either in one short length or made of one or two go and return portions so as to increase the heater length. In the second case, the go and return lengths are insulated with thin insulating strips. One of the multi-strip heater ends is either welded on the bimetal strip or directly to the input depending on the current path desired. The other end is generally welded on the terminal of the relay. Finally the multi-strip heater is fixed along the bimetal strip by staples to ensure a good thermal intimacy. Between the heater and bimetal strip, another insulating strip is placed. But for this kind of heater, the thickness of the bimetal thermal element will increase since several layers of heater are used. In many situations, the thickness of the bimetal thermal element is limited to the size of the product casing, and such a multi-strip heater can not be fit into the casing.

Therefore, there exists the requirement to improve a bimetal thermal element to realize a longer tripping time while maintaining a small volume, especially a small width to fit for many applications.

SUMMARY

Exemplary embodiments of the invention aim to solve the above-mentioned problems. An object of the exemplary embodiments is to provide a bimetal thermal element used for long tripping time applications and having a relatively smaller volume and a simple manufacturing process, thereby eliminating or at least partially alleviating the problems in the prior art.

In order to realize the foregoing object, the exemplary embodiments use as much as possible the common winding technique to provide a wound heater that is easy to manufacture and to define a current path in such a way that the current does not go through both the bimetal strip and its support or only low current goes though the bimetal strip and its support.

According to one aspect of the present invention, a bimetal thermal element is provided. The bimetal thermal element is adapted to assembling into a support. The bimetal thermal element includes a bimetal strip, a heater and an insulating device. The bimetal strip has a first end and a second end opposite to the first end, and a notch formed at the first end. The heater is made of a resistant strip including a linear portion and a wound portion, wherein the linear portion is straight and extending from a starting position near the second end of the bimetal strip toward the notch in the direction parallel to a side of the bimetal strip and the wound portion is wound around the bimetal strip and the linear portion. The insulating device is to insulate the bimetal strip from the heater.

According to one aspect of the present invention, a method for manufacturing a bimetal thermal element is provided. The method comprises:

preparing a bimetal strip including a notch at a first end thereof;

positioning a resistant strip parallel to a side of the bimetal strip with a starting position of a first portion thereof adjacent a second end of the bimetal strip opposite to the first end;

extending the first portion of the resistant strip from the starting position toward the notch;

enclosing the bimetal strip and the resistant strip with an insulating sheath;

folding the first portion of the resistant strip along an edge of the notch of the bimetal strip with a linear portion parallel to the side of the bimetal strip; and winding a wound portion of the first portion of the resistant strip around the linear portion of the first portion of the resistant strip and the bimetal strip at a predetermined winding angle.

By using the exemplary embodiments of the present invention, there is also no current within the bimetal strip and its support or only low current goes though the bimetal strip and its support, so the deflection of the bimetal strip is generated only by the temperature-rise coming from the resistant strip; therefore, it can realize a long tripping time. And since there is no current in the bimetal strip, it can be made of two layers instead of three layers when low electrical resistance is required.

As the thermal conduction coefficient of a two layer bimetal strip is lower than that of a three layer bimetal strip, in the bimetal strip made of two layers, the temperature-rise generated by the resistant strip will move slower and will reach the bottom of the bimetal strip later. Since the bottom of the bimetal strip is the most effective portion for deflection, the bimetal thermal element of this embodiment can realize a long tripping time. Additionally, since there is only one welding operation by resistance, the process of assembling becomes simpler.

DESCRIPTION OF THE FIGURES

Other aspects, features and merits of the present invention will be more easily understood and determined with reference to the figures and detailed description below.

Figure 1:
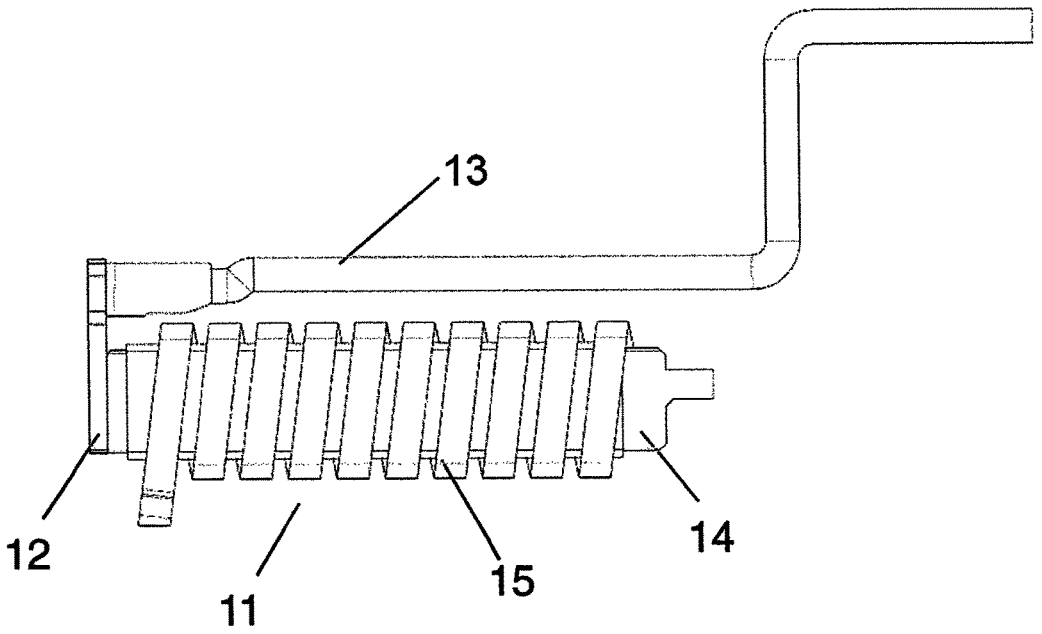
FIG. 1 shows the structure of the conventional bimetal thermal element.

The figures mean to describe the illustrative embodiments of the invention. They shall not be understood as defining the scope. Except where pointed out explicitly, the figures shall not be deemed to be drawn to scale.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Now, preferred embodiments are described with reference to the figures.

Embodiment 1

This embodiment provides a bimetal thermal element including a bimetal strip, a heater and an insulating device. The bimetal strip is either bonded by two metal strips or bonded by three metal strips. The bimetal strip bonded by three metal strips is made of two layers of the same metal strips and there is a third layer of metal strip between the above-mentioned two layers. The third layer is made of nickel or copper in order to reduce the electrical resistivity and to increase the thermal conductivity. The bimetal thermal element is adapted to assembling with a support and the heater is adapted to connecting with a terminal of the support and an input wire connected with a motor. The complete set of the bimetal thermal element with the support is adapted to being inserted into an overload relay case.

In this embodiment, the current path within the resistant strip is to be fully insulated from the bimetal strip. There is no welding point between the bimetal strip and the resistant strip.

Figure 2A:
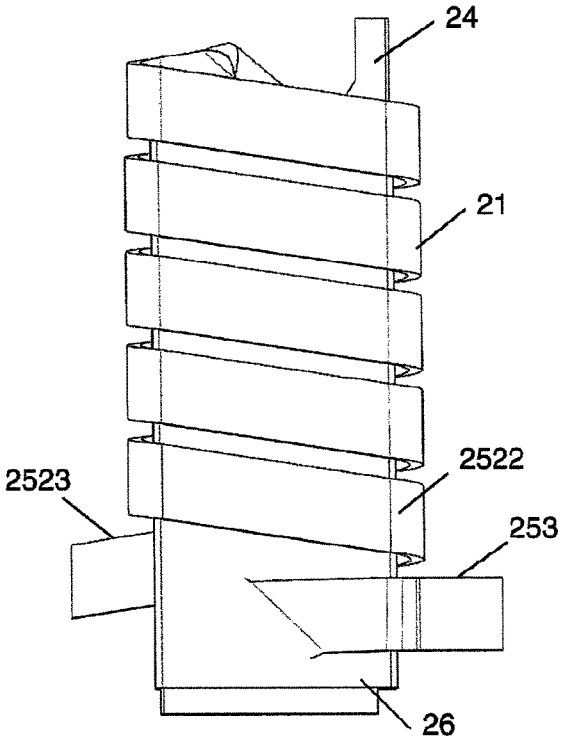
FIG. 2A shows the structure of the bimetal thermal element according to embodiment 1 of the invention.
Figure 2B:
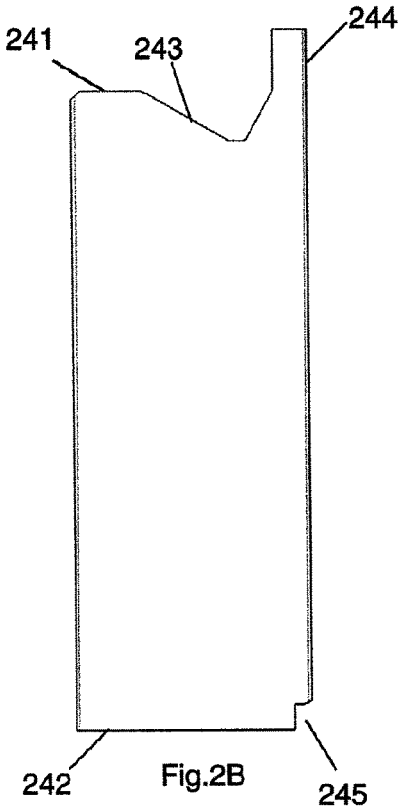
FIG. 2B shows the structure of the blank bimetal strip according to embodiment 1 of the invention.

As shown in FIG. 2A, a bimetal thermal element 21 is provided. The bimetal thermal element 21 includes a bimetal strip 24, a heater 25 and an insulating device 26 to insulate the bimetal strip 24 from the heater 25. As shown in FIG. 2B, the bimetal strip 24 has a first end 241 and a second end 242 opposite to the first end 241, and the bimetal strip 24 has two sides, one side with a higher expansion coefficient and the other side with a lower expansion coefficient opposite to the one with the higher expansion coefficient. The bimetal strip 24 has a notch 243 at the first end 241, and it also has a protrusion 244 for action on the tripping bar at the first end 241. Preferably, the bimetal strip 24 has a small cutting 245 near its second end 242. The cutting 245 serves as a depth stop for its entrance into the support 22 (not shown in FIG. 2B).

Figure 2C:
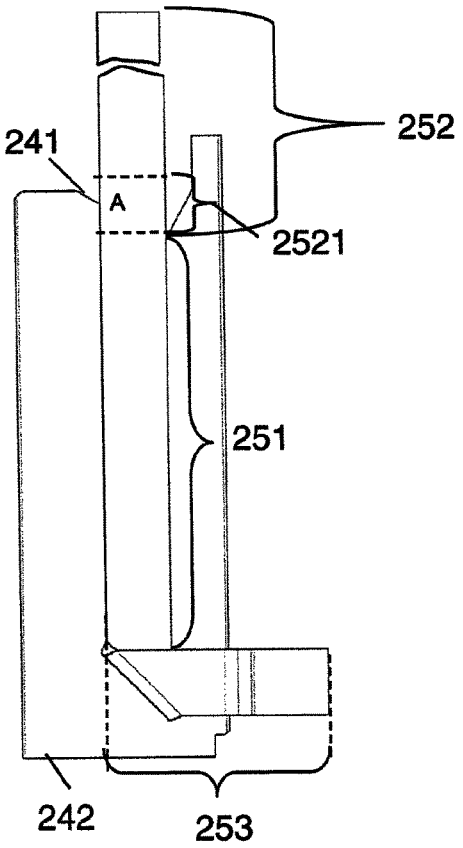
FIG. 2C illustrates the structure of the resistant strip of the bimetal thermal element according to embodiment 1 of the invention.

FIG. 2C illustrates the structure of the resistant strip of the bimetal thermal element according to embodiment 1 of the invention. In the status shown in FIG. 2C, the resistant strip 25 is not wound around the bimetal strip 24 yet. As shown in FIG. 2C, the heater 25 is made of a resistant strip 25 which includes a linear portion 251 and a wound portion 252. The linear portion 251 is straight and from a position (referred to as a "starting position") near the second end 242 of the bimetal strip 24, extending to the notch 243 in a direction parallel to a side of the bimetal strip 24. The wound portion 252 is wound around the bimetal strip 24 and the linear portion 251. The starting position of the linear portion 251 is decided by the position of the terminal at the support 22 (not shown in FIG. 2C).

As shown in FIG. 2A and FIG. 2C, the wound portion 252 includes a first portion 2521 and a second portion 2522. The first portion 2521 has a length "A" to allow it to be folded around the notch 243 of the bimetal strip 24 from the linear portion 2521. The second portion 2522 is wound around the bimetal strip 24 and the linear portion 251. The second portion 2522 has a length proportional to the number of turns of the heater to be wound around the bimetal strip 24. The second portion 2522 of the wound portion 252 starts from the opposite side of the bimetal strip 24 to the side of the bimetal strip 24 where the linear portion 251 is set. And the second portion 2522 of the wound portion 252 is connected with the linear portion 251 by the first portion 2521 of the wound portion 252. Preferably, the resistant strip 25 further includes a terminal end 2523 stretching from the second portion 2522 of the wound portion 252 for connecting with a terminal in the relay case (not shown in FIG. 2C).

The linear portion 251 of the resistant strip 25 is preferably set on the lower expansion side of the bimetal strip 24 so as to warm up that side of the bimetal strip 24 first which is non-operant in the deflection process.

As shown in FIG. 2A and FIG. 2C, the resistant strip 25 further includes a folded portion 253, folded from the starting position of the linear portion 251 with a folding angle. Preferably, the folding angle is 45° so as to get a right angle between the linear portion 251 and the folded portion 253. The folded portion 253 is adapted to welding with the terminal of the support 22 and the input wire 23 at an end of the folded portion 253.

In the present embodiment shown in FIG. 2A, the insulating device 26 includes insulating sheet 261 (not shown in FIG. 2A) and insulating sheath 262.

Figure 2D:
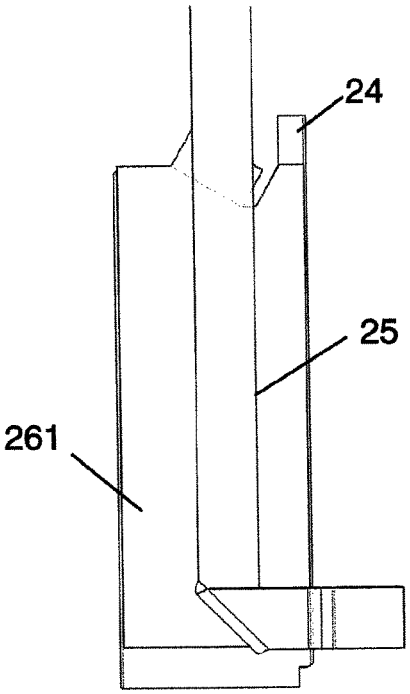
FIG. 2D illustrates the structure of the insulating sheet of the bimetal thermal element according to embodiment 1 of the invention.

FIG. 2D illustrates the structure of the insulating sheet 261 of the bimetal thermal element 21 according to embodiment 1 of the invention. In the status shown in FIG. 2D, the insulating sheet 11 is just inserted between the bimetal strip 24 and the linear portion 251 of the resistant strip 25 and the wound portion 252 is not wound around the bimetal strip 24 yet. As shown in FIG. 2D, the insulating sheet 261 is between the resistant strip 25 and the bimetal strip 24. The insulating sheet 261 has a shape designed to cover the incline edge of the notch 243 of the bimetal strip 24 after folding so as to ensure no electrical contact between the bimetal strip 24 and the resistant strip 25. In the present embodiment, the insulating sheet 261 is made of a kind of Nomex material. It can also be made of other insulating materials, as long as the dielectric strength, the thermal conductivity are equivalent.

The insulating sheath 262 is slid around the linear portion 251 of the resistant strip 25 and the bimetal strip 24. The second portion 2522 of the wound portion 252 is wound around the insulating sheath 262 to prevent the second portion 2522 of the wound portion 252 from touching the linear portion 251 of the resistant strip 25 and the bimetal strip 24. The insulating sheath 262 is partially cut to allow one end of the folded portion 253 to get out from the insulating sheath 262. The material of insulating sheath 262 is glass fiber; it can also be made of other insulating materials, such as Nomex type materials.

The form and configuration of the insulating device 26 are not limited to the above-mentioned ones, any types of insulating device 26 able to insulate the resistant strip 25 from the bimetal strip 24 can be used. And if the resistant strip 25 is made of a material having a very low resistivity such as copper, the insulating sheet 261 between the bimetal strip 24 and the linear portion 251 of the resistant strip 25 can be omitted.

Figure 3A:
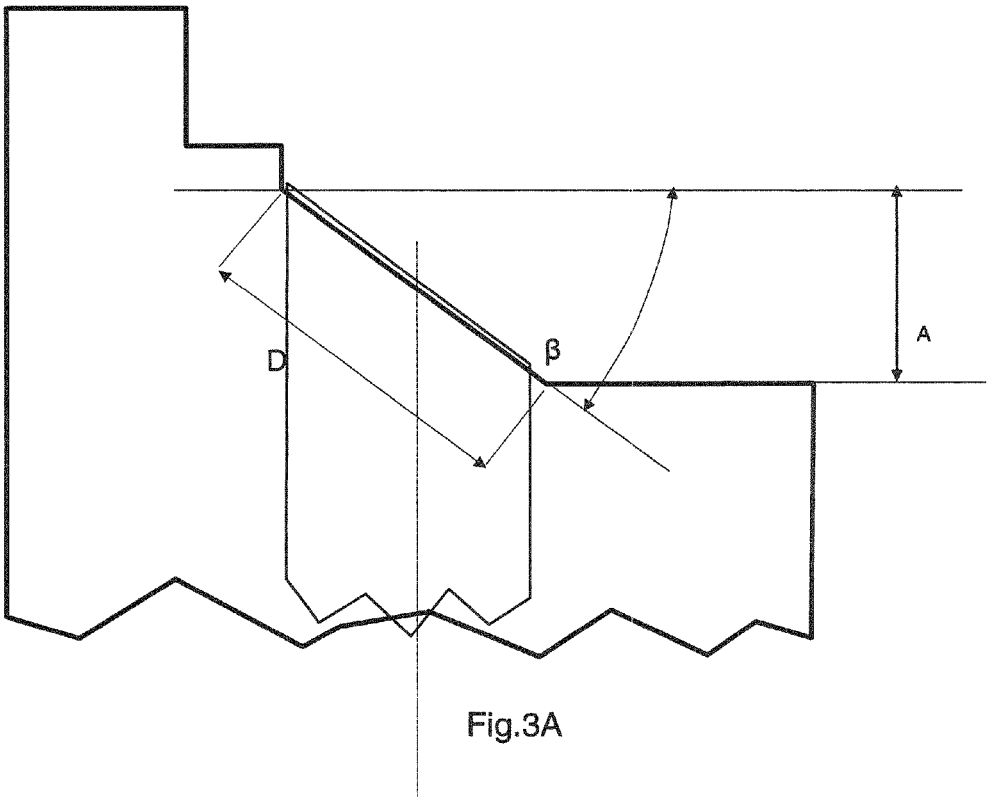
FIGS. 3A-3D illustrate the dimensions of the bimetal strip and the resistant strip of the bimetal thermal element according to embodiment 1 of the invention.

It is preferred to design the dimensions of the bimetal strip and the resistant strip as follows. FIG. 3A illustrates the relation between the dimension of the bimetal strip 24 and the dimension of the resistant strip 25. Referring to FIG. 3A, suppose the length of the edge of the notch 243 around which the first portion 2521 of the wound portion 252 is folded is D. The incline angle of the above-mentioned edge of the notch 243 is β. Preferably, the linear portion 251 of the resistant strip 25 is parallel with planes of the bimetal strip 24 which connect the first end 241 and the second end 242. In this situation, since the resistant strip needs to fold around the incline edge of the notch, D shall satisfy the following condition:

$$D > W/\text{cosine}\ \beta,$$

wherein W is the width of the resistant strip.

Suppose the length of the first portion 2521 of the wound portion 252 of the resistant strip 25 is A, in that case A shall satisfy the following condition:

$$A = W \cdot \text{TAN}\ \beta,$$

wherein W is the width of the resistant strip.

Figure 3B:
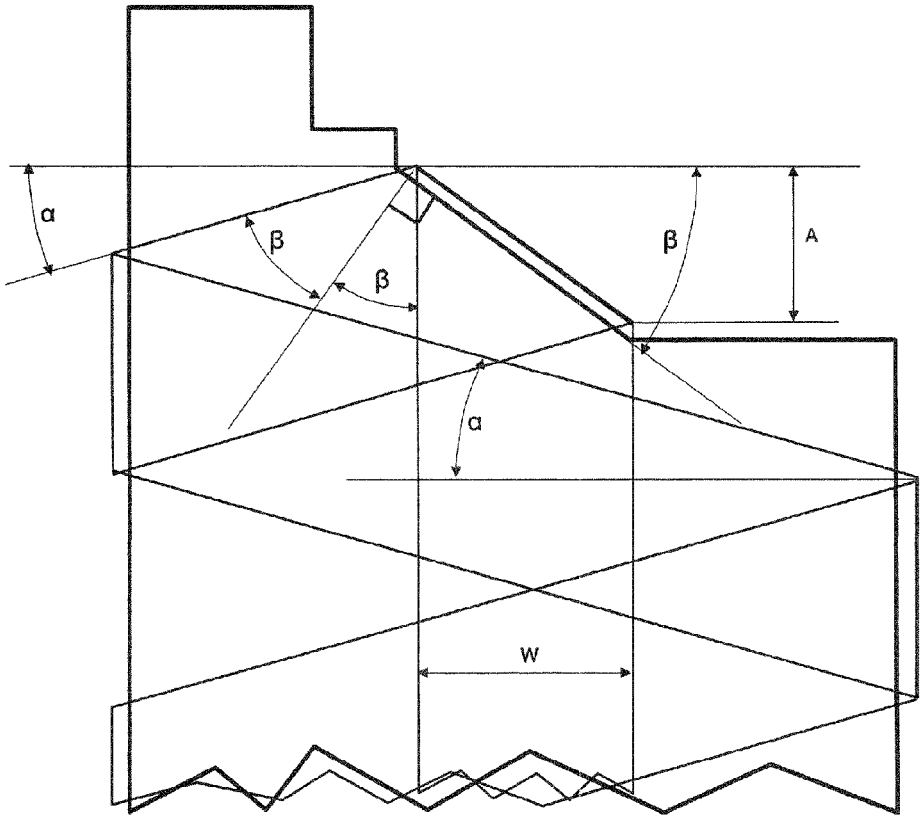
Figure 3C:
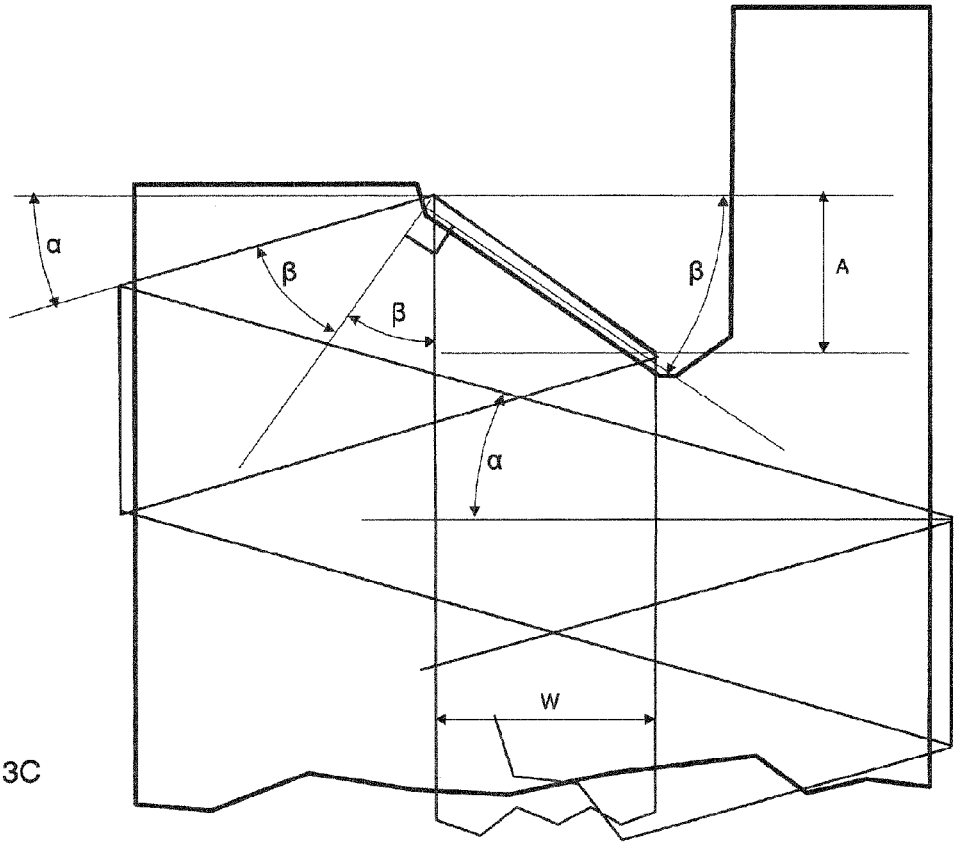

FIG. 3B and FIG. 3C illustrate the relation between the incline angle of above-mentioned edge of the notch β and a winding angle α of the resistant strip. FIG. 3B and FIG. 3C are two possible layouts of the resistant strip 25 and the bimetal strip 24. In FIG. 3B, the protrusion 244 is on the left of the notch 243, and in FIG. 3C, the protrusion 244 is on the right of the notch 243. As can be seen both from FIGS. 3B and 3C, β is linked to the winding angle α by the following formula:

$$\beta = (90° - \alpha)/2,$$

wherein α is a winding angle of the resistant strip 25.

Figure 3D:
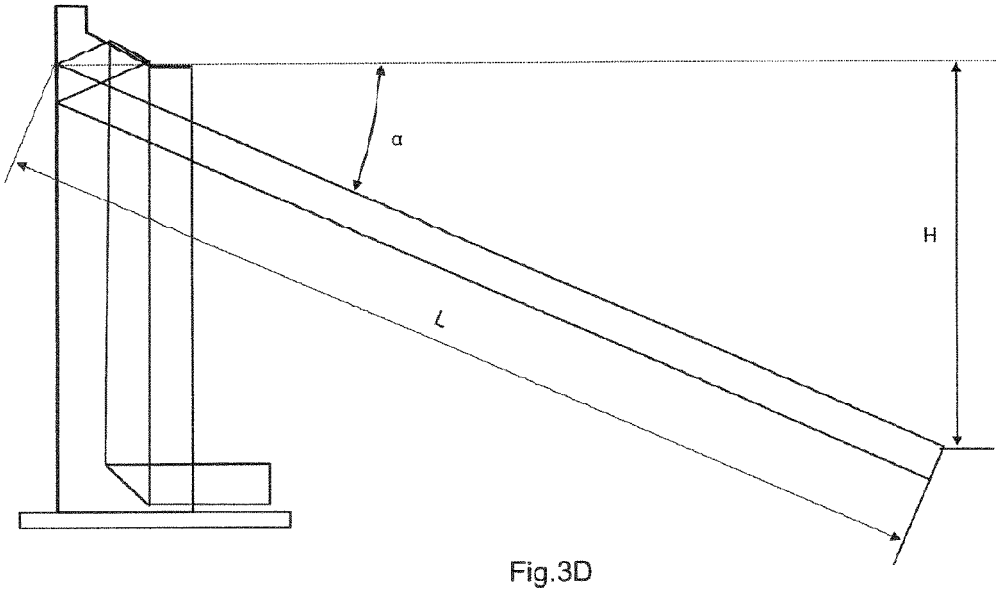

Winding angle α depends on the number of turns desired for the wound portion. As shown in FIG. 3D, the winding angle α is calculated by the following formula:

$$\alpha = \text{arcsine}(H/L),$$

wherein, L is the efficient winding length of the resistant strip 25, and H is winding height.

To explain the configuration of bimetal thermal element 21 more clearly, now the specific steps of the manufacturing process of the bimetal thermal element 21 are explained with reference to FIGS. 4A-4F.

Figure 4A:
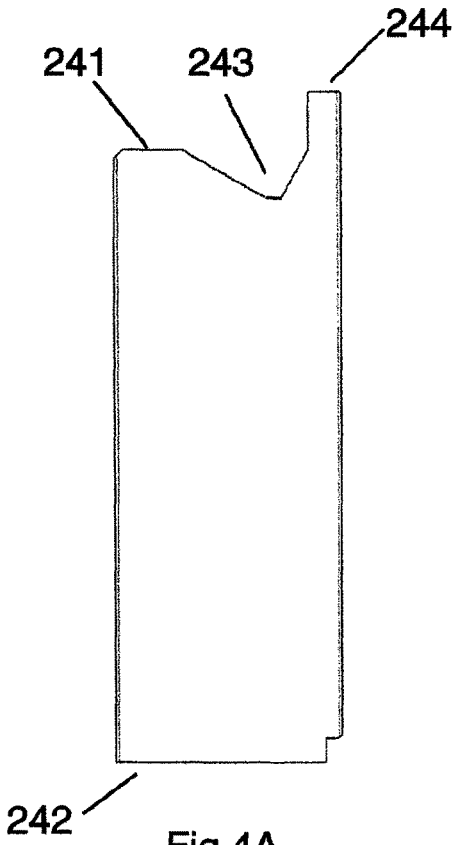
FIGS. 4A-4F illustrate the manufacturing process of the bimetal thermal element according to embodiment 1 of the invention.

Step 1: Preparing a bimetal strip 24 including a notch 243 and a protrusion 244 for action on the tripping bar at its first end, as shown in FIG. 4A.

Figure 4B:
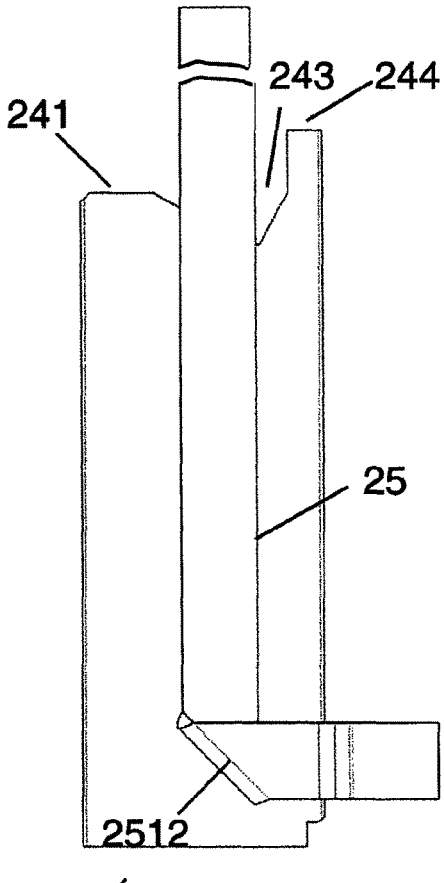

Step 2: Preparing a resistant strip 25, folding the resistant strip 25 to have a first portion and a second portion, as shown in FIG. 4B. The angle between these two portions are substantially 90°. The first portion is to be divided into a linear portion 251 and a wound portion 252 in later steps, the second portion here is adapted to be the folded portion 253.

Step 3: Positioning the resistant strip 25 parallel to a side of the bimetal strip 24 with a connecting portion 2512 between the first portion and the second portion located at a position (starting position) near the second end 242 of the bimetal strip 24 and extending the first portion from the connecting portion 2512 toward the notch 243, as shown in FIG. 4B. The position of the connecting portion 2512 between the first portion and the second portion is decided by the position of the terminal at the support 22.

As previously mentioned, the folded portion 253 of the resistant strip 25 can be omitted in some situations. Therefore, step 2 can be omitted. In this situation, step 3 can be described as follows: preparing a resistant strip 25 having a first portion, positioning the resistant strip 25 parallel to a side of the bimetal strip 24 with a starting position of a first portion of the resistant strip 25 near the second end 242 of the bimetal strip 24 and extending the first portion from the starting position toward the notch 243.

Figure 4C:
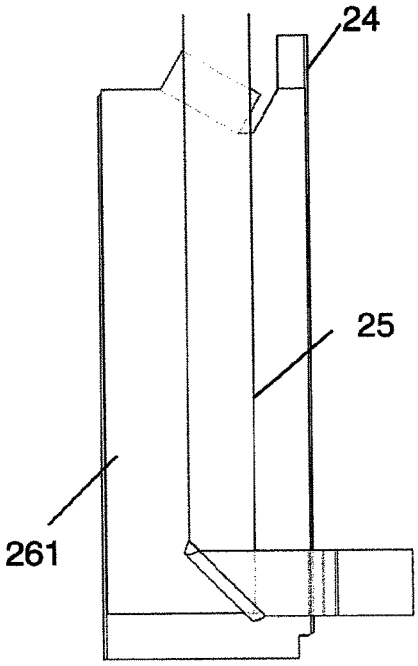

Step 4: Putting an insulating sheet 261 between the bimetal strip 24 and the first portion of the resistant strip 25 with a part having a specific shape at the head thereof, as shown in FIG. 4C. The specific shape at the head of the sheet 261 will be folded later to cover the edge of the notch 243 around which the resistant strip 25 will be folded.

Figure 4D:
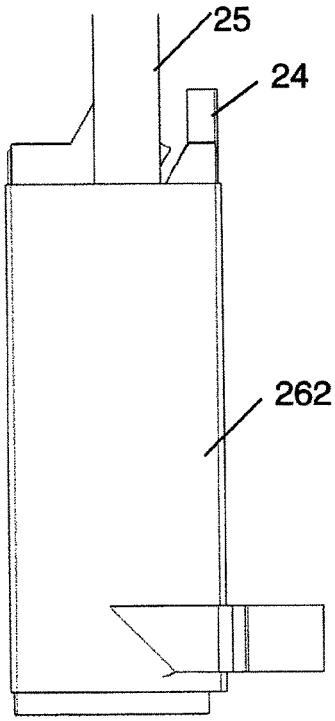

Step 5: Positioning the bimetal strip 24, insulating sheet 261 and resistant strip 25 into an insulating sheath 262, as shown in FIG. 4D. The sheath 262 is partially cut to allow the end of the resistant strip 25 to get out from the sheath 262.

Figure 4E:
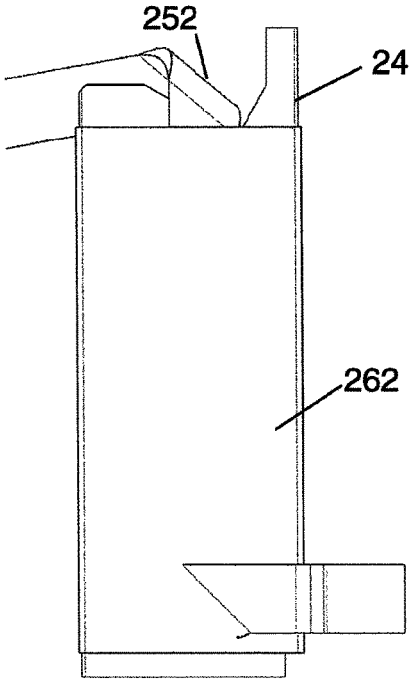

Step 6: Folding the resistant strip 25 along the edge of the notch 243 of the bimetal strip 24, as shown in FIG. 4E. The part having the specific shape of the insulating sheet 261 will also be folded with the resistant strip to cover the edge of the notch 243 of the bimetal strip 24. Therefore the resistant strip 25 is insulated from the bimetal strip 24 due to the rectangular pre-cut shape made within the insulating sheet 261. After this step, the first portion of the resistant strip 25 is divided into linear portion 251 and wound portion 252.

Figure 4F:
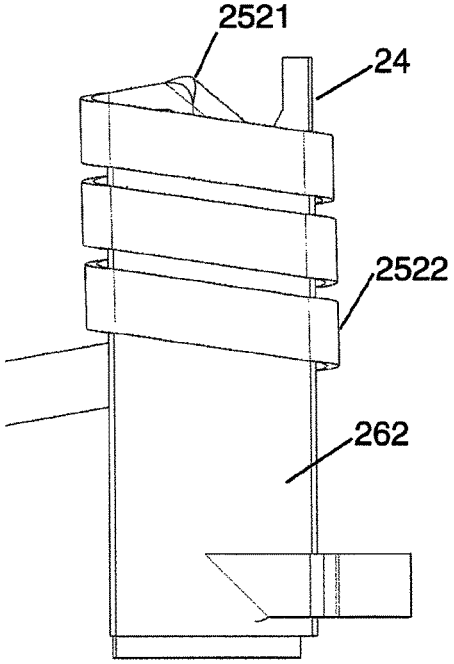

Step 7: Winding the wounded portion of the resistant strip 25 around the bimetal strip and the linear portion wherein the number of turns is defined by the winding angle $\alpha$, as shown in FIG. 4F. The number of turns will define the final vertical position of the wound portion 252 of the resistant strip 25. After this step, the wound portion 252 is divided into the first portion 2521 and the second portion 2522.

It is preferable to include the step of cutting the resistant strip 25 according to a dimension that allows a final good positioning for the resistance welding with a terminal in the relay case which is adapted to connecting with the resistant strip 25. After this step, the terminal end 2523 of the resistant strip 25 is formed.

After that, the bimetal thermal element 21 made of the bimetal strip 24, the insulating device 26 and the resistant strip 25 is finished and ready to be assembled with its support 22 by laser welding or other methods, such as riveting.

As previously mentioned, the insulating sheet 261 can be omitted if the resistant strip 25 is made of a material having a very low resistivity, such as copper. In this situation, step 4 can be omitted, too.

Figure 5A:
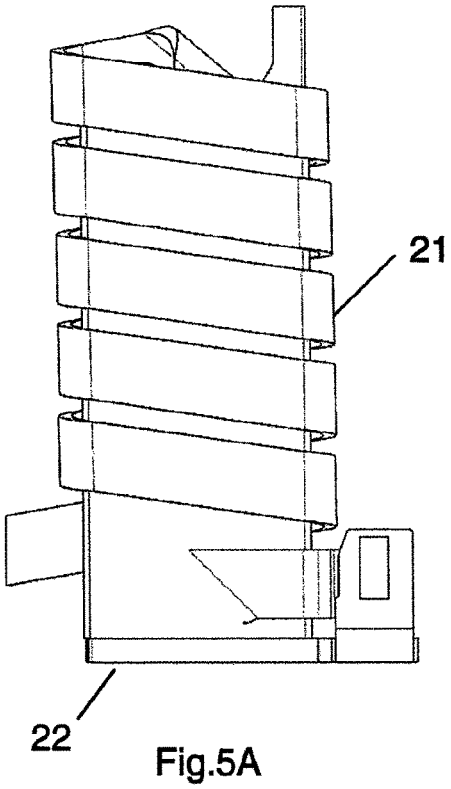
FIGS. 5A-5C illustrate the process to assemble the bimetal thermal element with the support according to embodiment 1 of the invention.
Figure 5B:
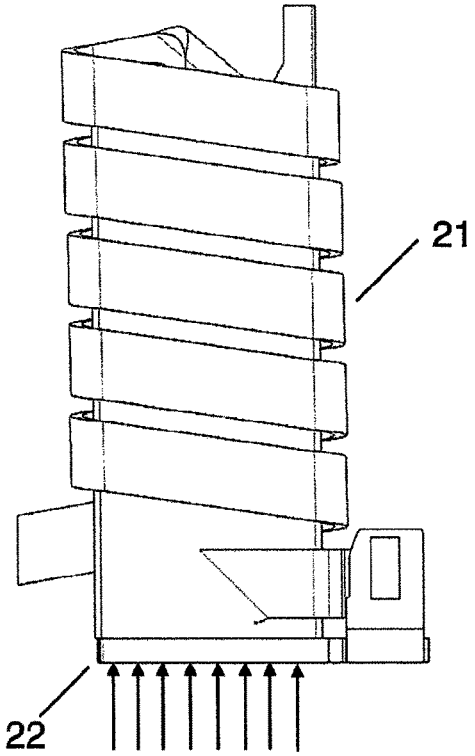
Figure 5C:
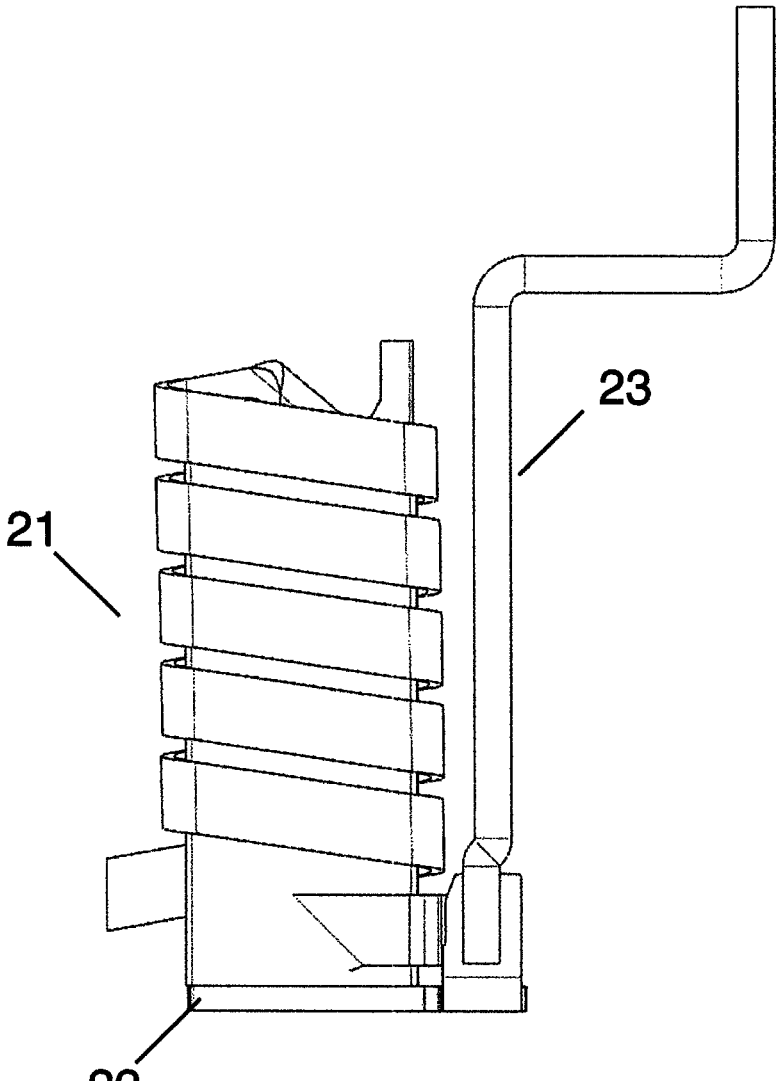

Now, the process to assemble the bimetal element with the support is explained with reference to FIGS. 5A-5C.

Step 8: Positioning the bimetal thermal element 21 with its support 22 for the laser welding operation, as shown in FIG. 5A. A jig allows a right positioning within all X, Y, and Z directions.

Step 9: Laser welding between bimetal strip 24 and the support 22, as shown in FIG. 5B.

Step 10: Resistance welding of the support 22, the input wire 23 and the resistant strip 25, as shown in FIG. 5C.

After that, the complete thermal element after resistance welding is inserted within an overload relay case, and then the terminal end of the resistant strip 25 is welded to the terminal in the relay case.

Some steps of the manufacturing process of the bimetal thermal element of the present embodiment are the same for conventional bimetal thermal elements, the process mainly differs in:

1) getting the bimetal strip prepared with a notch for the wound portion of the resistant strip to wind around; and 2) getting the resistant strip prepared with a linear portion and positioning the bimetal strip and the linear portion at the right position before winding.

As can be seen from the above description, the bimetal thermal element provided by the present embodiment has the following advantages over conventional bimetal thermal elements:

1) The way of getting the resistant strip around the bimetal strip without any current within both the bimetal strip and its support allows the bimetal strip to warm up only due to radiation and conduction to the resistant strip in the transient state (time<10 s). So the deflection of the bimetal strip is generated only by the temperature-rise coming from the resistant strip, and therefore, it can realize a long tripping time.

2) Since there is only one welding operation by resistance (step 10), the process of assembling becomes simpler.

3) Since there is no current in the bimetal strip, it can be made of two layers instead of three layers when low electrical resistance is required. The two-layer bimetal strip can be AS type of Imphy™ company or 155 type of Kanthal™ company or L1 type of EMS™ company. The bimetal strip made of two layers is less expensive than the one made of three layers, and therefore the cost of the whole element will be reduced.

4) The deflection coefficient of the bimetal strip made of two layers is higher than the one made of three layers, so the bimetal strip can have more deflection and it is easier to adjust current tripping.

5) As the thermal conduction coefficient of the two-layer bimetal strip is lower than that of the three-layer bimetal strip, compared to the bimetal strip made of three layers, in the bimetal strip made of two layers, the temperature-rise generated by the resistant strip will move slower and will reach the bottom of the bimetal strip later. Since the bottom of the bimetal strip is the most effective portion for deflection, the bimetal thermal element of this embodiment can realize a long tripping time.

Embodiment 2

The structure of the bimetal thermal element of embodiment 2 is mostly the same as that of embodiment 1. The main difference lies in that there is a fixing point realized by welding between the linear portion of the resistant strip and the bimetal strip.

Figure 6A:
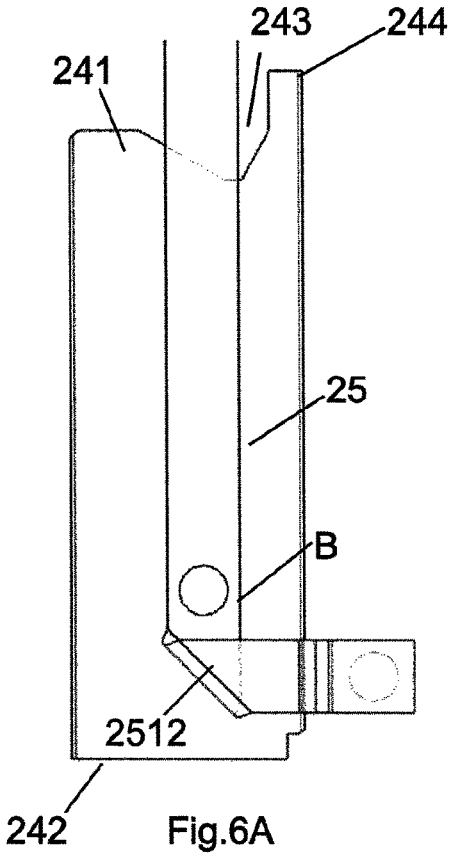
FIGS. 6A-6B illustrate steps 3 and 4 of the manufacturing process of the bimetal thermal element according to embodiment 2 of the invention.

The specific steps of the manufacturing process of the bimetal thermal element of embodiment 2 are mostly the same as that of embodiment 1. The main difference lies in step 3 and step 4. Steps 3 and 4 of embodiment 2 are as follows:

Step 3: Positioning the resistant strip 25 parallel to a side of the bimetal strip 24 with a connecting portion 2512 between the first portion and the second portion located at a position near the second end 242 of the bimetal strip 24 and the first portion extending from the connecting portion toward the notch 243, as shown in FIG. 6A. The position of the connecting portion 2512 between the first portion and the second portion is decided by the position of the terminal at the support 22. Same as in Embodiment 1, in the situation where step 2 is omitted, step 3 can be described as follows: preparing a resistant strip 25 having a first portion, positioning the resistant strip 25 parallel to a side of the bimetal strip 24 with a starting position of a first portion of the resistant strip 25 near the second end 242 of the bimetal strip 24 and extending the first portion from the starting position toward the notch 243. Then, fixing the linear portion 251 of the resistant strip 25 and the bimetal strip 24 by a resistance welding operation at a position near the connecting portion 2512. In FIG. 6A, "B" is referring to the fixing point.

Figure 6B:
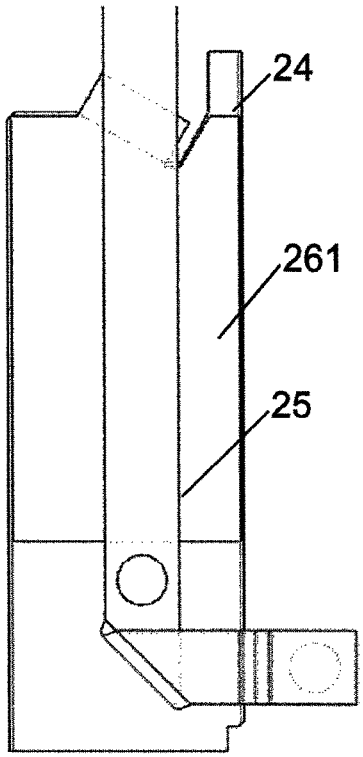

Step 4: Folding the resistant strip 25 to have a small gap for the insulating sheet 261 to be inserted, and then putting the insulating sheet 261 between the bimetal strip 24 and the resistant strip 25 to touch the step made in the resistant strip, as shown in FIG. 6B. Since the linear portion 251 is welded to bimetal strip 24 at point "B", the resistant strip 25 needs to fold to have a small gap for the insulating sheet 261 to be inserted.

In this situation, there is a low current within the portion made by the bimetal strip 24 and its support 22. The whole bimetal thermal element 21 equals two current branches connected in parallel. The two terminals of these two branches are the welding point between the linear portion 251 of the resistant strip 25 and the bimetal strip 24 and the welding point between the input wire 23, the support 22 and the folded portion 253 of the resistant strip 25. One branch is made by the support 22 and the bimetal strip 24, and the other branch is made by the resistant strip 25.

The electrical resistance in the branch made by the support 22 and the bimetal strip 24 is significantly higher than the one made by the resistant strip 25 between the two terminals. The current flowing within the branch is inversely proportional to the ratio of those electrical resistances. Therefore, there is only a very small current in the bimetal strip 24 and the support 22. There thus will be little heat produced due to the current in the bimetal strip 24 and the support 22. Accordingly, the tripping performance will be almost the same as that of the bimetal element 21 of embodiment 1.

Besides the advantage described in connection with embodiment 1, embodiment 2 further has the following advantage: due to the welding point, relative positioning of the bimetal strip and the resistant strip is fixed, and thus the manipulation becomes much easier.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

The invention claimed is:

1. A bimetal thermal element adapted to assembling into a support, comprising:

a bimetal strip having a first end, a second end opposite to the first end, and a notch formed at the first end;

a heater made of a resistant strip including a linear portion and a wound portion, wherein the linear portion is straight and extending from a starting position near the second end of the bimetal strip to the notch in a direction parallel to a side of the bimetal strip and the wound portion of the resistant strip is folded around the notch of the bimetal strip so as to wind around the bimetal strip and the linear portion of the resistant strip; and an insulating device to insulate the bimetal strip from the heater.

2. The bimetal thermal element according to claim 1, wherein:

the wound portion of the resistant strip includes a first portion folded around the notch of the bimetal strip and a second portion wound around the bimetal strip and the linear portion of the resistant strip;

the second portion of the wound portion of the resistant strip starts from a side of the bimetal strip opposite to where the linear portion is set; and the second portion of the wound portion of the resistant strip is coupled to the linear portion of the resistant strip via the first portion of the wound portion.

3. The bimetal thermal element according to claim 2, the dimensions of the bimetal strip and the resistant strip satisfying the following condition:

$$D > W/\text{cosine } \beta,$$

wherein, D is the length of an edge of the notch around which the first portion of the wound portion of the resistant strip is folded, W is the width of the resistant strip, and 3 is the incline angle of the edge of the notch.

4. The bimetal thermal element according to claim 2, the dimensions of the bimetal strip and the resistant strip satisfying the following condition:

$$A = W \cdot \text{TAN } \beta,$$

wherein, A is the length of the first portion of the wound portion of the resistant strip, W is the width of the resistant strip, and β is the incline angle of an edge of the notch around which the first portion of the wound portion of the resistant strip is folded.

5. The bimetal thermal element according to claim 2, wherein the dimension of the bimetal strip and the resistant strip satisfies the following condition:

$$\beta = (90° - \alpha)/2,$$

wherein, β is the incline angle of an edge of the notch around which the first portion of the wound portion of the resistant strip is folded, and α is a winding angle of the wound portion of the resistant strip.

6. The bimetal thermal element according to claim 2, wherein the resistant strip further includes a folded portion folded from the starting position of the linear portion with a folding angle.

7. The bimetal thermal element according to claim 6, wherein the folding angle is 45° to result in a right angle between the linear portion and the folded portion of the resistant strip.

8. The bimetal thermal element according to claim 2, wherein the resistant strip further includes a terminal portion stretching from the second portion of the wound portion of the resistant strip.

9. The bimetal thermal element according to claim 1, wherein the insulating device includes a sheath adapted to preventing the second portion of the wound portion of the resistant strip from touching the linear portion of the resistant strip and the bimetal strip.

10. The bimetal thermal element according to claim 9, wherein the insulating device further includes a sheet adapted to insulating the linear portion and the first portion of the wound portion of the resistant strip from the bimetal strip.

11. The bimetal thermal element according to claim 1, wherein the insulating device completely insulates the bimetal strip from the resistant strip.

12. The bimetal thermal element according to claim 1, further including a fixing point between the bimetal strip and linear portion of the resistant strip, near the starting position of the linear portion.

13. The bimetal thermal element according to claim 12, wherein the insulating device insulates the bimetal strip from the resistant strip except the portion adjacent the fixing point.

14. The bimetal thermal element according to claim 1, wherein the bimetal strip is made of two layers.

15. The bimetal thermal element according to claim 1, wherein the bimetal strip has a first side with higher thermal expansion coefficient and a second side with lower thermal expansion coefficient, the linear portion of the resistant strip is set on the second side of the bimetal strip.

16. A method for manufacturing a bimetal thermal element, comprising:

preparing a bimetal strip including a notch at a first end thereof;

positioning a resistant strip parallel to a side of the bimetal strip with a starting position of a first portion thereof adjacent a second end of the bimetal strip opposite to the first end;

extending the first portion of the resistant strip from the starting position toward to the notch;

enclosing the bimetal strip and the resistant strip with an insulating sheath;

folding the first portion of the resistant strip along an edge of the notch of the bimetal strip with a linear portion of the resistant strip parallel to the side of the bimetal strip; and folding a wound portion of the first portion of the resistant strip around the notch of the bimetal strip so as to wind around the linear portion of the first portion of the resistant strip and the bimetal strip at a predetermined winding angle.

17. The method according to claim 16, further comprising: fixing the linear portion of the resistant strip and bimetal strip at a position adjacent the starting position of the first portion of the resistant strip before enclosing the bimetal strip and the resistant strip with the insulating sheath.

18. The method according to claim 16, further comprising: putting an insulating sheet between the bimetal strip and the linear portion of the resistant strip with a part having a specific shape at a head of the insulation sheet adapted to being folded later to cover an edge of the notch before enclosing the bimetal strip and the resistant strip with the insulating sheath.

19. The method according to claim 16, further comprising: folding the resistant strip at a folding angle to divide the resistant strip into the first portion and a second portion before positioning the resistant strip parallel to the side of the bimetal strip with the starting position of the first portion of the resistant strip near the second end of the bimetal strip opposite to the first end.

20. The method according to claim 17, further comprising: putting an insulating sheet between the bimetal strip and the linear portion of the resistant strip with a part having a specific shape at a head of the insulation sheet adapted to being folded later to cover an edge of the notch before enclosing the bimetal strip and the resistant strip with the insulating sheath.

21. The method according to claim 17, further comprising: folding the resistant strip at a folding angle to divide the resistant strip into the first portion and a second portion before positioning the resistant strip parallel to the side of the bimetal strip with the starting position of the first portion of the resistant strip near the second end of the bimetal strip opposite to the first end.

* * * * *